US007798652B2

(12) United States Patent
Ikeda et al.

(10) Patent No.: US 7,798,652 B2
(45) Date of Patent: Sep. 21, 2010

(54) DISPLAY SHELF AND DISPLAY SHELF SYSTEM FOR PROJECTING PROJECTOR IMAGES DISPLAYING INFORMATION ABOUT ARTICLES

(75) Inventors: Yoshihiko Ikeda, Shizuoka (JP); Hiroki Mochizuki, Shizuoka (JP); Masanori Takeuchi, Shizuoka (JP); Makoto Nozawa, Shizuoka (JP); Wang Yun, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 754 days.

(21) Appl. No.: 11/728,287

(22) Filed: Mar. 23, 2007

(65) Prior Publication Data

US 2007/0229767 A1 Oct. 4, 2007

(30) Foreign Application Priority Data

Mar. 28, 2006 (JP) ..... 2006-089231
Sep. 20, 2006 (JP) ..... 2006-255072

(51) Int. Cl.
*G03B 21/22* (2006.01)

(52) U.S. Cl. ..... 353/74; 353/78; 359/449; 359/460

(58) Field of Classification Search ..... 353/74, 353/77, 78; 211/153; 359/499, 449, 460
See application file for complete search history.

(56) References Cited

U.S. PATENT DOCUMENTS 6,869,187 B2 * 3/2005 Muramatsu ..... 353/76
2005/0012995 A1 * 1/2005 Chang ..... 359/460
2006/0214875 A1 * 9/2006 Sonehara ..... 345/8
2008/0151197 A1 6/2008 Mochizuki et al.
2008/0190875 A1 8/2008 Ikeda et al.
2008/0204672 A1 8/2008 Ikeda et al.

FOREIGN PATENT DOCUMENTS

DE 3116145 A1 11/1982
DE 29808656 U1 10/1998

(Continued)

OTHER PUBLICATIONS

An Extended European Search Report dated Dec. 19, 2008, issued in a counterpart European Application.

(Continued)

*Primary Examiner*—Thanh X Luu
*Assistant Examiner*—Francis M Legasse, Jr.
(74) *Attorney, Agent, or Firm*—Frishauf, Holtz, Goodman & Chick, P.C.

(57) ABSTRACT

Transmission-type screens are placed corresponding to a display board at a front area of the display board, on which an article is placed. Each of the screens transmits and projects a projector image luminous flux projected from a backside of the screens to a front side of the screens. When the projector image luminous flux is projected from the backside of the screens, each of inner circumferences which defines a space including an image projecting space for leading the projector image luminous flux to the backside of the screens without obstruction. A display shelf might have a projector and a computer. The projector projects the projector image luminous flux. The display shelf might have a reflecting mirror which lead the projector image flux to the screens.

9 Claims, 12 Drawing Sheets

FOREIGN PATENT DOCUMENTS

| | | | |
|---|---|---|---|
| JP | 07-017608 | A | 1/1995 |
| JP | 07-231838 | A | 9/1995 |
| JP | 2001-245756 | A | 9/2001 |
| JP | 2005-0998888 | A | 4/2005 |
| WO | WO 02/054918 | A1 | 7/2007 |

OTHER PUBLICATIONS

Related U.S. Appl. No. 11/899,374, filed Sep. 5, 2007; Inventors: Yoshihiko Ikeda et al; Title: Display Shelf.

Related U.S. Appl. No. 12/002,736, filed Dec. 18, 2007; Inventors: Hiroki Mochizuki et al; Title: Image Display Controller for Display Shelf.

Related U.S. Appl. No. 12/070,696, filed Feb. 20, 2008; Inventors: Yoshihiko Ikeda et al; Title: Display Shelf and Display Shelf System.

Chinese Office Action dated Mar. 20, 2009 (9 pages), and partial English translation thereof (8 pages), issued in counterpart Chinese Application Serial No. 2007100884587.

Chinese Office Action dated Oct. 9, 2009 and English translation thereof issued in a counterpart Chinese Application No. 2007100884587.

* cited by examiner

DISPLAY SHELF AND DISPLAY SHELF SYSTEM FOR PROJECTING PROJECTOR IMAGES DISPLAYING INFORMATION ABOUT ARTICLES

CROSS-REFERENCE TO RELATED APPLICATION

The present application is based on and claims the benefit of priority of Japanese Patent Applications 2006-89231 filed on Mar. 28, 2006, and 2006-255072, filed on Sep. 20, 2006, the entire contents of which are incorporated herein by reference.

BACKGROUND OF THE INVENTION

1. Field of the Invention

The present invention relates to a display shelf and a display shelf system suitable for displaying an article, and more particularly, related to a display shelf and a display shelf system for projecting a projector image luminous flux of information about an article to be displayed.

2. Discussion of Related Art

A display shelf is used widely in a retail shop, such as a supermarket, a convenience store, and a department store. In such the retail shops, an article is displayed on the display shelf, and an inventory tag corresponding to the article is set to the display shelf. The purpose of the inventory tag is to give information about a price of the article and so on to customers.

In recent years, an electric inventory tag has been developed as the inventory tag (see Japanese Laid-Open which comprises (a) a placing table for placing an article, (b) a screen positioned at a front area of the placing table, and for transmitting and projecting a projector image luminous flux projected from a back side of the screen to a back surface of the screen, and (c) an inner circumference which defines a space including an image projecting space which leads the projector image luminous flux projected from the back side of the screen to the back surface of the screen without obstruction, (2) a projector which projects the projector image luminous flux on the screen, and (3) a computer which transmit an image data to the projector.

BRIEF DESCRIPTION OF THE DRAWINGS

A more complete application of the present invention and many of the attendant advantage thereof will be readily obtained as the same becomes better understood by reference to the following detailed description when considered in connection with the accompanying drawings, wherein.

DETAILED DESCRIPTION OF THE PREFERRED EMBODIMENTS

An embodiment of the present invention will be explained with reference to FIGS. 1 to 7. A first embodiment relates to a display shelf system 11 preferably applied to a supermarket.

Figure 1:
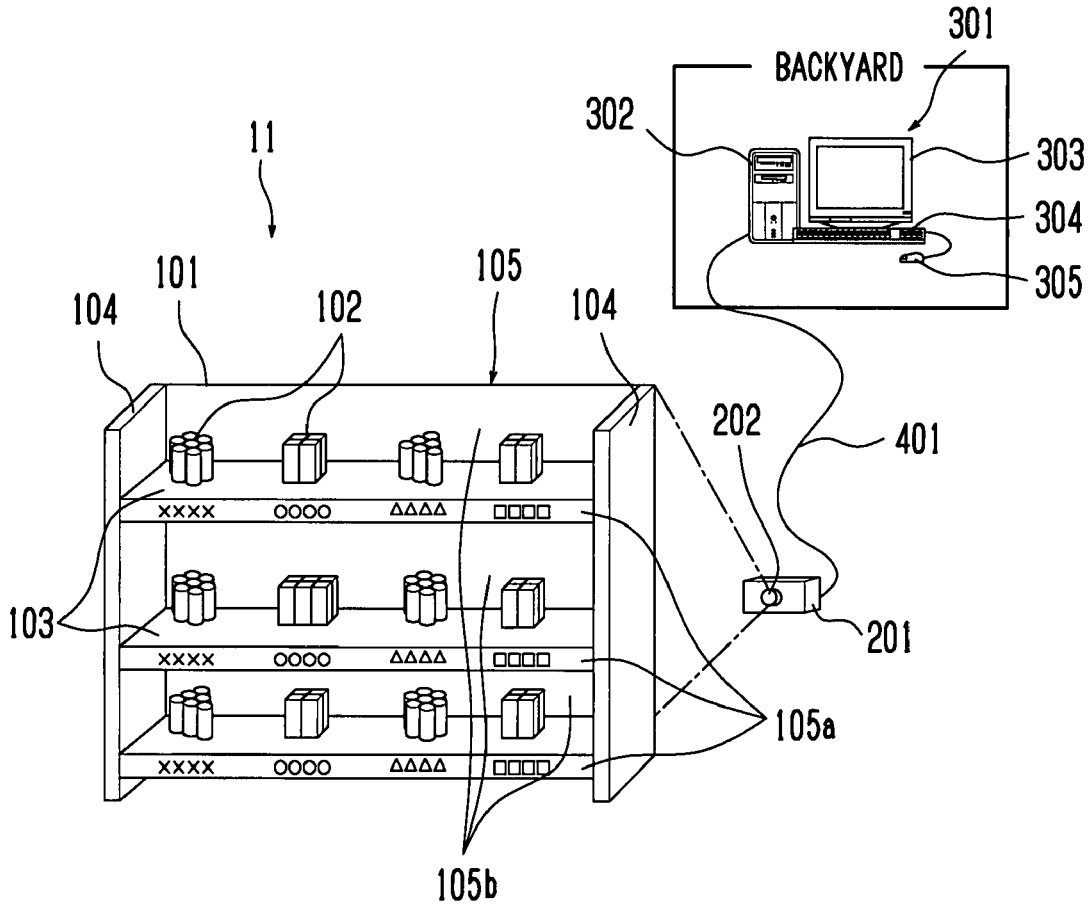
FIG. 1 is a schematic view showing a display shelf system of the first embodiment of the present invention.

FIG. 1 is a schematic view showing a display shelf system of the first embodiment of the present invention. The display shelf system 11 comprises a display shelf 101, a projector 201, and a computer 301. The display shelf 101 is placed in the store. The projector 201 is placed behind the display shelf 101. The computer 301 is located in a backyard of the display shelf 101. The projector 201 and the computer 301 are connected via a network wire 401.

The display shelf 101 comprises three placing tables 103. The three placing tables 103 are arranged with having a predetermined space in an up and down direction. Each of the three placing tables 103 is capable of placing and displaying an article 102. Side surfaces of the placing tables 103 are supported by a pair of side panels 104. The display shelf 101 also comprises a screen 105 for each placing table 103. The screen 105 has a first and a second screens 105*a* and 105*b*. Each of the first screen 105*a* extends vertically downward from a front end of the placing table 103. Each of the second screen 105*b* is placed vertically upward from a back end of the placing table 103.

The first screen 105*a* is placed at a front area of the placing table 103. Meanwhile, the second screen 105*b* is placed at a back area of the placing table 103. The first and the second screens 105*a* and 105*b* comprise a frosted glass structure, for instance, and are a transmission-type screen capable of transmitting and projecting a projector image luminous flux from a back side to a front side thereof. Each of the first and the second screens 105*a* and 105*b* is formed fully in the across the width direction of the placing table 103 without a cut line.

The projector 201 comprises a lens 202. The projector 201 is placed at a predetermined position. The projector 201 projects fluxes of projector images through the lens 202 to the first and the second screens 105*a* and 105*b*. The projector 201 constitutes, for instance, a crystal liquid projector. The projector 201 receives an image data transmitted from the computer 301 placed at the backyard, and generates the projector image luminous flux based on the image data and projects it through the lens 202 to the screens 105.

The computer 301 comprises a body tower 302, a display 303, a keyboard 304, and a pointing device 305 such as a mouse, and the like.

Figure 2:
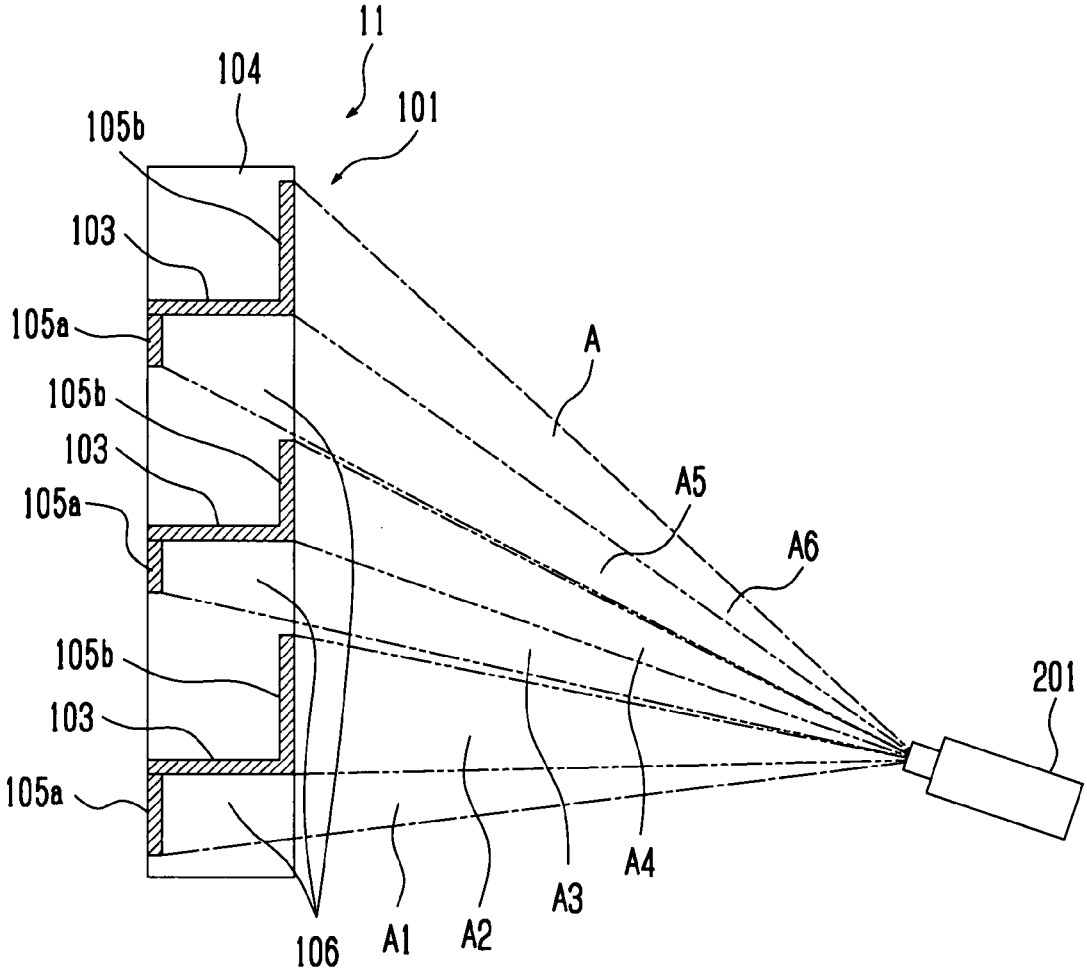
FIG. 2 is a side view in vertical section showing a positional relationship between a display shelf and a projector of the first embodiment of the present invention.

FIG. 2 is a side view in vertical section showing a positional relationship between a display shelf 101 and a projector 201 of the first embodiment of the present invention. As shown in FIG. 2, a projector image luminous flux is projected in an image projecting space 'A' shown by the dashed line. The image projecting space 'A' of the projector 201 is divided into a plurality of image projecting spaces A1, A2, A3, A4, A5, and A6.

The image projecting space A1 corresponds to the first screen 105*a*, which is provided at the lower placing table 103. The image projecting space A2 corresponds to the second screen 105*b*, which is provided at the lower placing table 103. The image projecting space A3 corresponds to the first screen 105*a*, which is provided at the middle placing table 103. The image projecting space A4 corresponds to the second screen 105*b*, which is provided at the middle placing table 103. The image projecting space A5 corresponds to the first screen 105*a*, which is provided at the upper placing table 103. The image projecting space A6 corresponds to the second screen 105*b*, which is provided at the upper placing table 103.

To secure the image projecting spaces A3 and A5 for the first screen 105*a*, an upper surface of each of the second screens 105*b* is placed to have a predetermined distance from a bottom surface of each of the placing tables 103.

Further, the first screen 105*a* provided at the lower placing table 103 extends vertically downward. By this, the image projecting space A1 for the first screen 105*a* provided at the lower placing table 103 is ensured.

To secure the image projecting spaces A1, A3, and A5 for the first screen 105*a*, a bottom surface of the placing table 103, an upper surface of the screen 105*b*, and an inner surface of the side panels 104 constitute an inner circumference which defines a space including the image projecting space 106 which leads the projector image luminous flux projected from the back sides of the screen 105*a* and 105*b* to the back surface of the screen 105*a* without obstruction.

Figure 3:
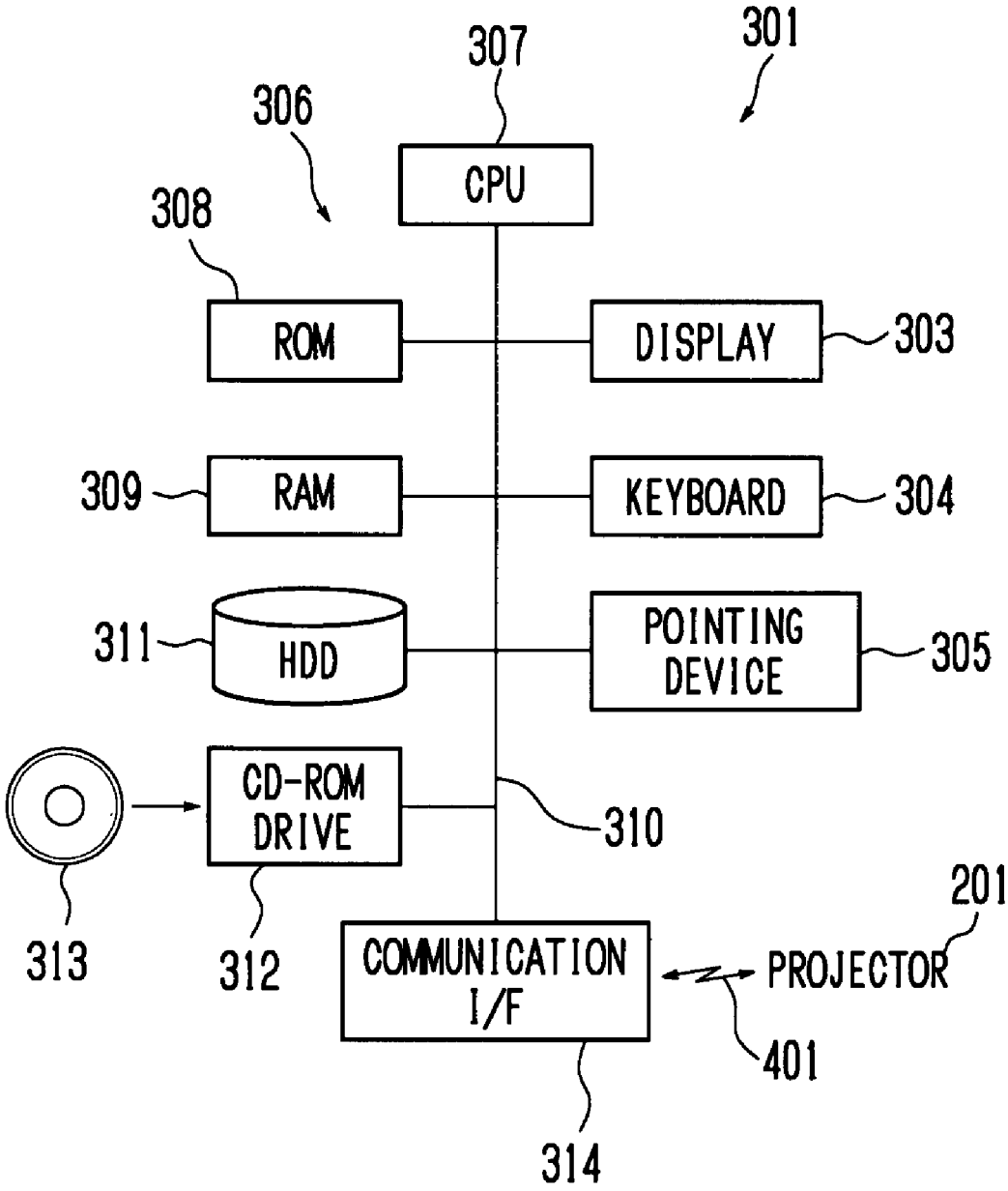
FIG. 3 is a block diagram showing a hardware structure of a computer of the first embodiment of the present invention.

FIG. 3 is a block diagram showing a hardware structure of a computer 301 of the first embodiment of the present invention. The computer 301 has a microcomputer 306 as an information processor. The microcomputer 306 has a CPU 307, a ROM 308, a RAM 309 and a bus line 310. The CPU 307, the ROM 308, and the RAM 309 are connected via the bus line 310. The CPU 307 executes various processings. The ROM 308 stores a data fixably such as BIOS and the like. The RAM 309, used as a work area, stores various variable data rewritably.

The microcomputer 306 connects a HDD (Hard Disk Drive) 311 and a CD-ROM drive 312. As an example, the CD-ROM drive 312 reads information from the CD-ROM 313 which stores OS (Operating System, See FIG. 4) and various application programs, and installs these information to the HDD 311.

Also, the display 303, the keyboard 304, and the pointing device 305 are connected to the microcomputer 306. The display 303 is an output device for outputting a data from the microcomputer 306. The keyboard 304 and the pointing device 305 are input devices for inputting a data to the microcomputer 306.

Further, a communication interface 314 is connected to the microcomputer 306. The communication interface 314 supports a protocol which enables a communication between the microcomputer 306 and the projector 201 via the network wire 401.

Figure 4:
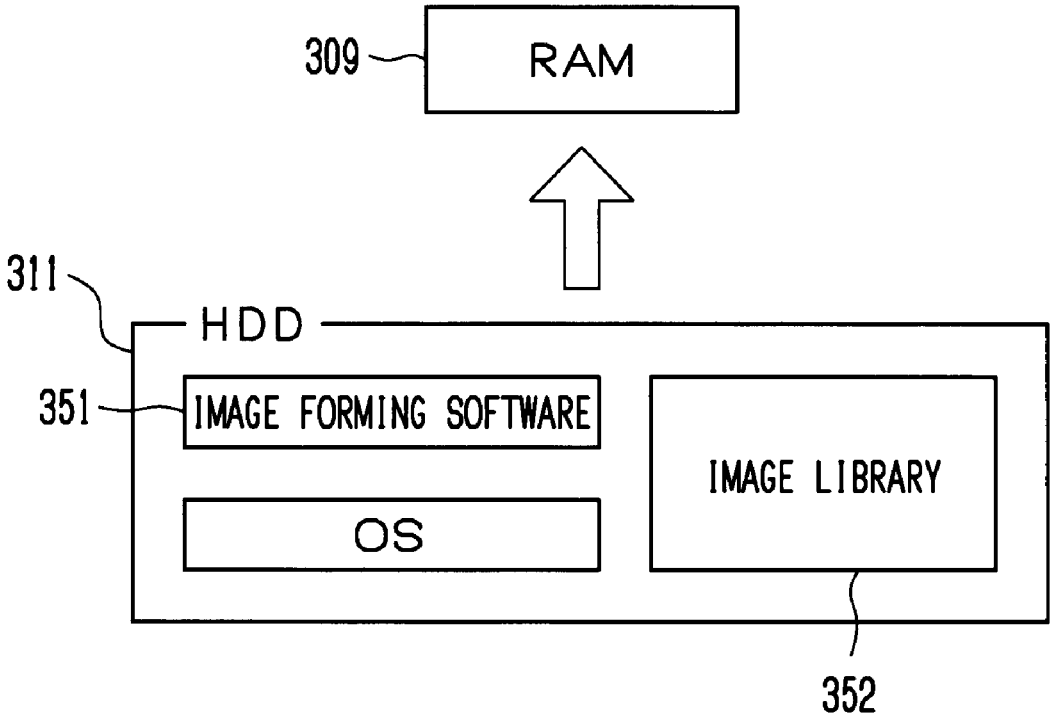
FIG. 4 is a block diagram showing mechanism in the computer for editing and generating an image data of the first embodiment of the present invention.

FIG. 4 is a block diagram showing mechanism in the computer 301 for editing and generating an image data of the first embodiment of the present invention.

The computer 301 enables an edition and a generation of the image data. For such processes, the computer 301 has an image forming software 351 as an application programs installed in the HDD 311. In addition, an image library 352, which is used with the image forming software 351, is also installed in the HDD 311.

As for the image forming software 351, Microsoft PowerPoint (product name), for example, can be used. This image forming software 351 enables the computer 301 to edit and generate the image data, and to lap a letter over the generated image data. Further, during the editing and generating process of the image data, the image forming software 351 uses various model images included in the image library 352, and pastes them onto the generated image data. The image library 352 stores various photograph data and picture data regarding foods, and so on as model images.

All or a part of the image forming software 351 are copied into the RAM 309 on its initial process to make the process speed based on the image forming software 351 faster. Also, in accompanying with the copy of the image forming software 351 to the RAM 309, all or a part of the image library 352 are copied to make the process speed faster. Then, the microcomputer 306 transmits the image date edited and generated by the image forming software 351 from the communication interface 314 to the projector 201 via the network wire 401.

Figure 5:
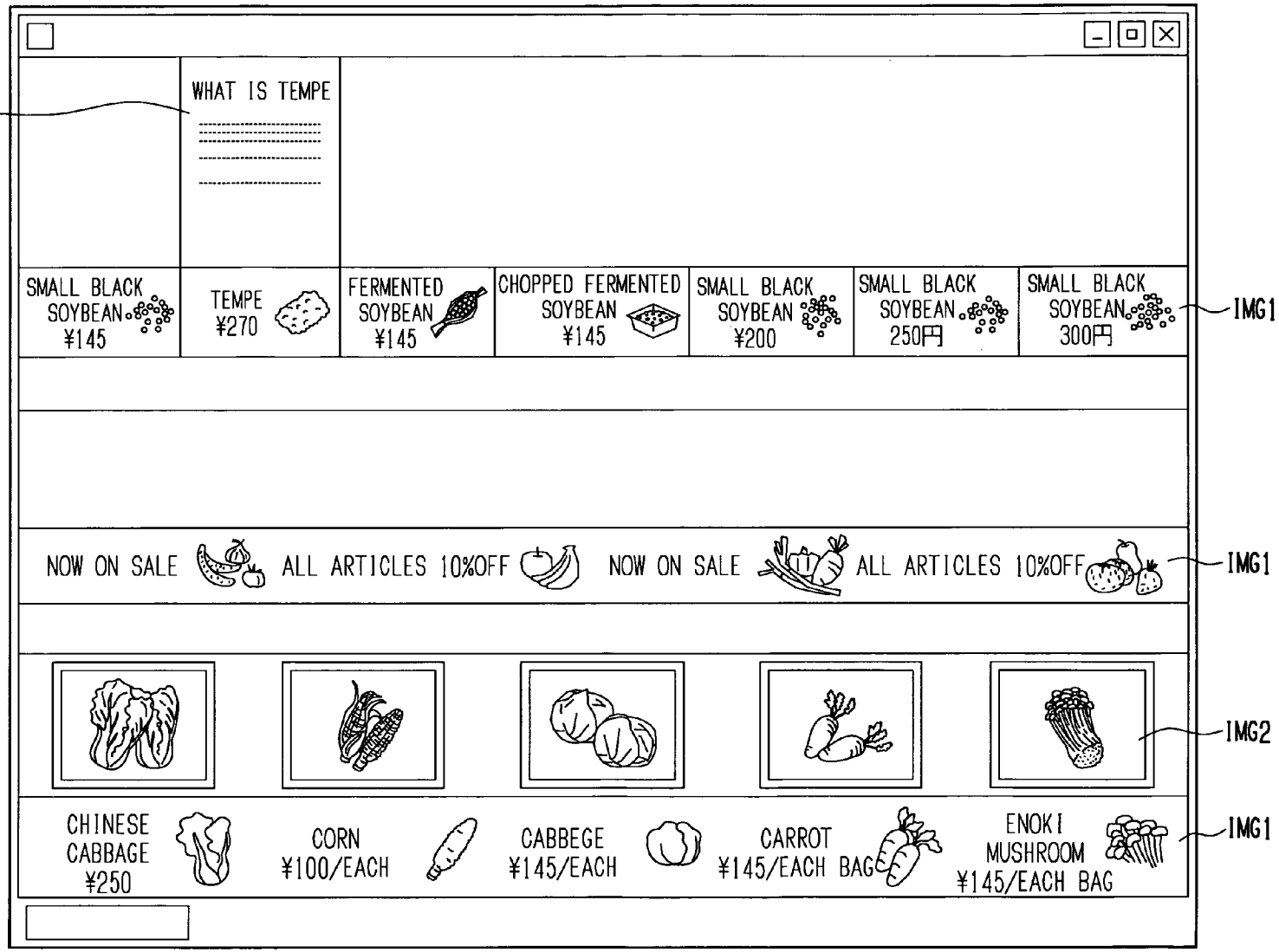
FIG. 5 is an illustrative view showing an example of the image data generated by the computer of the first embodiment of the present invention.

FIG. 5 is an illustrative view showing an example of the image data edited and generated by the computer 301, which bases the projector image luminous flux of the projector 201 in the first embodiment of the present invention. The image data shown in FIG. 5 is illustrated as an image picture displayed on the display 303 of the computer 301. The image data has three band-shape first images IMG 1, which are transmitted and projected onto the three first screens 105*a*, which are provided in the three placing tables 103.

Further, the image data has a second image IMG 2 for transmitting and projecting on the second screen 105*b*, which are provided in the upper and lower placing tables 103. Here, an area except the first image IMG 1 and the second image IMG 2 of the image data is blacked out.

The first image IMG 1 to be transmitted and projected on the first screen 105*a*, which is provided in the lower placing table 103, constitutes letter displays such as [Chinese Cabbage], [Corn], [Cabbage], [Carrot], [Enoki Mushroom], price displays of these foods by certain amounts, and picture displays of these foods.

The picture display can be acquired from the image library 352. When the image forming software 351 is PowerPoint, for example, the picture display can be displayed in a swing manner. The first image IMG 1 to be transmitted and projected on the first screen 105*a*, which is provided at the lower placing table 103, is not divided into backgrounds, which corresponds to each article, and shares one background. The second image IMG 2 to be transmitted and projected on the second screen 105*b*, which is provided at the lower placing table 103 is the picture images of [Chinese Cabbage], [Corn], [Cabbage], [Carrot], and [Enoki Mushroom]. The picture images can be acquired from the image library 352.

The first image IMG 1 to be transmitted and projected on the first screen 105*a* provided in the middle placing table 103 is a letter display of [Now on Sale, All Items 10% OFF], and picture displays of corresponding articles. When the image forming software 351 is PowerPoint, for example, the letter display and the picture displays can be scrolled.

The first image IMG 1 to be transmitted and projected on the first screen 105*a* provided in the upper placing table 103 constitutes letter displays such as [Small Black Soybean], [Tempe], [Fermented Soybean], [Chopped Fermented Soybean], [Small Black Bean], [Small Black Soybean], and

[Small Black Soybean] and its price displays by certain amounts, as well as their picture displays.

The picture displays can be acquired from the image library 352. When the image forming software 351 is PowerPoint, for example, the picture displays can be displayed in a swing manner. The first image IMG 1 to be transmitted and projected on the first screen 105*a*, which is provided in the upper placing table 103, is divided into background images corresponding to each article, and the backgrounds are divided by different colors. The second image IMG 2 to be projected on the second screen 105*b*, which is provided in the upper placing table 103, is an explanation of an article named [Tempe].

Figure 6:
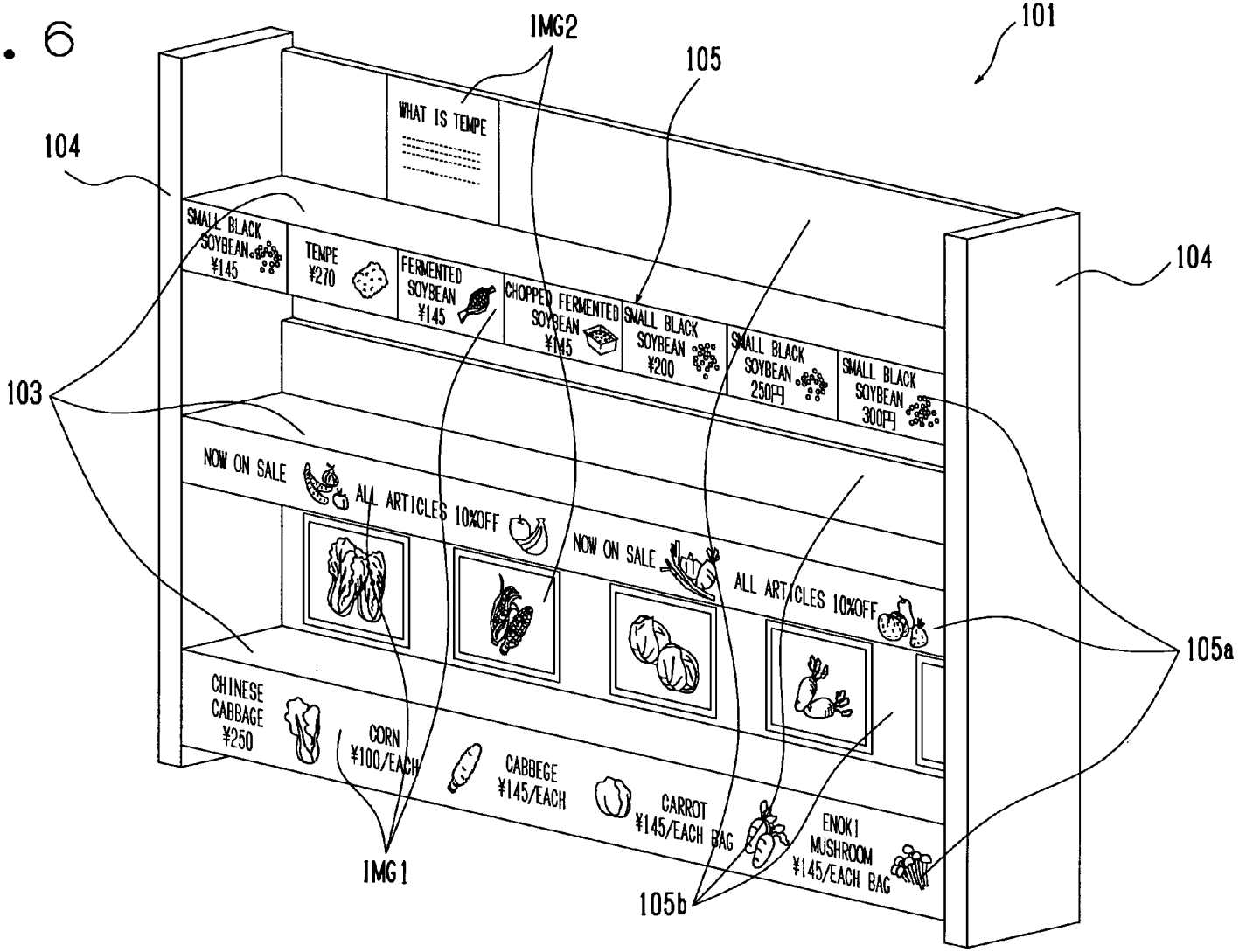
FIG. 6 is a perspective view showing an example of the display shelf in relation to the first embodiment of the present invention.

FIG. 6 is a perspective view showing an example of the display shelf in relation to the first embodiment of the present invention.

The computer 301 transmits the image data including the image illustrated in FIG. 5 from the communication interface 314 to the projector 201 via the network wire 401. The projector 201 generates a projector image luminous flux based on the received image data when receives a image data, and projects it to the screens 105 through the lens 202. As a result, the projector image luminous flux from the projector 201 is transmitted and projected to the first and the second screens 105*a* and 105*b* provided in each of the placing tables 103 of the display shelf 101.

As shown in FIG. 6, the three band-shaped first images IMG 1, which the image data shown in FIG. 5 has, are transmitted and projected to the first screens 105*a* respectively provided in the three placing tables 103. Also, the second images IMG 2, which the image data shown in FIG. 5 has, are projected to the second screen 105*b* respectively provided in the upper and lower placing tables 103. In this case, it is possible for a swinging display or a scrolling display to be displayed as they are in the screens 105 shown in FIG. 6.

As explained above, according to the first embodiment of the present invention, since the projector image luminous flux is transmitted and projected by the projector 201 on the screens 105 provided in the display shelf 101, the information display area can be taken wide. Further, according to the first embodiment of the present invention, since it is possible to display the projector image luminous flux not only on the first screens 105*a* extended downward from the front end part of the placing tables 103, but also on the second screens 105*b* positioned at the back sides of the placing tables 103, the information display area can be enlarged.

In addition, according to the first embodiment of the present invention, to project the projector image luminous flux, various types of images can be projected to the first and the second screens 105*a* and 105*b*. For instance, as shown in FIG. 6, the first image IMG 1 transmitted and projected to the first screen 105*a*, which is provided in the lower placing table 103, is not divided into background images corresponding to each article and shares one background. Therefore, a natural, beautiful image without a joint can be obtained throughout a width of one placing table 103 in comparison with a conventional display example such as an electronic inventory tag, and so on.

Meanwhile, as shown in FIG. 6, the first image IMG 1 transmitted and projected on the first screen 105*a* provided in the upper placing table 103 is divided into background images corresponding to respective articles. Such divisions are not depending on to a structure of a display device such as the conventional electric inventory tag. The divisions can be edited and generated by the image data (see FIG. 5) editable and generatable by the computer 301, and more flexible layout is possible.

Further, in the first embodiment of the present invention, image example of the projector image luminous flux projected to the first and the second screens 105*a* and 105*b* have great freshness. This freshness enhances a customer attraction.

Further more, it is possible for the first embodiment of the present invention to have POP advertisement function which can be seen as a letter display such as "Now on Sale, All Articles 10% OFF" along with a picture display of corresponding articles. Further, the POP advertisement function can be enhanced easily by scrolling letter displays and picture displays.

Figure 7:
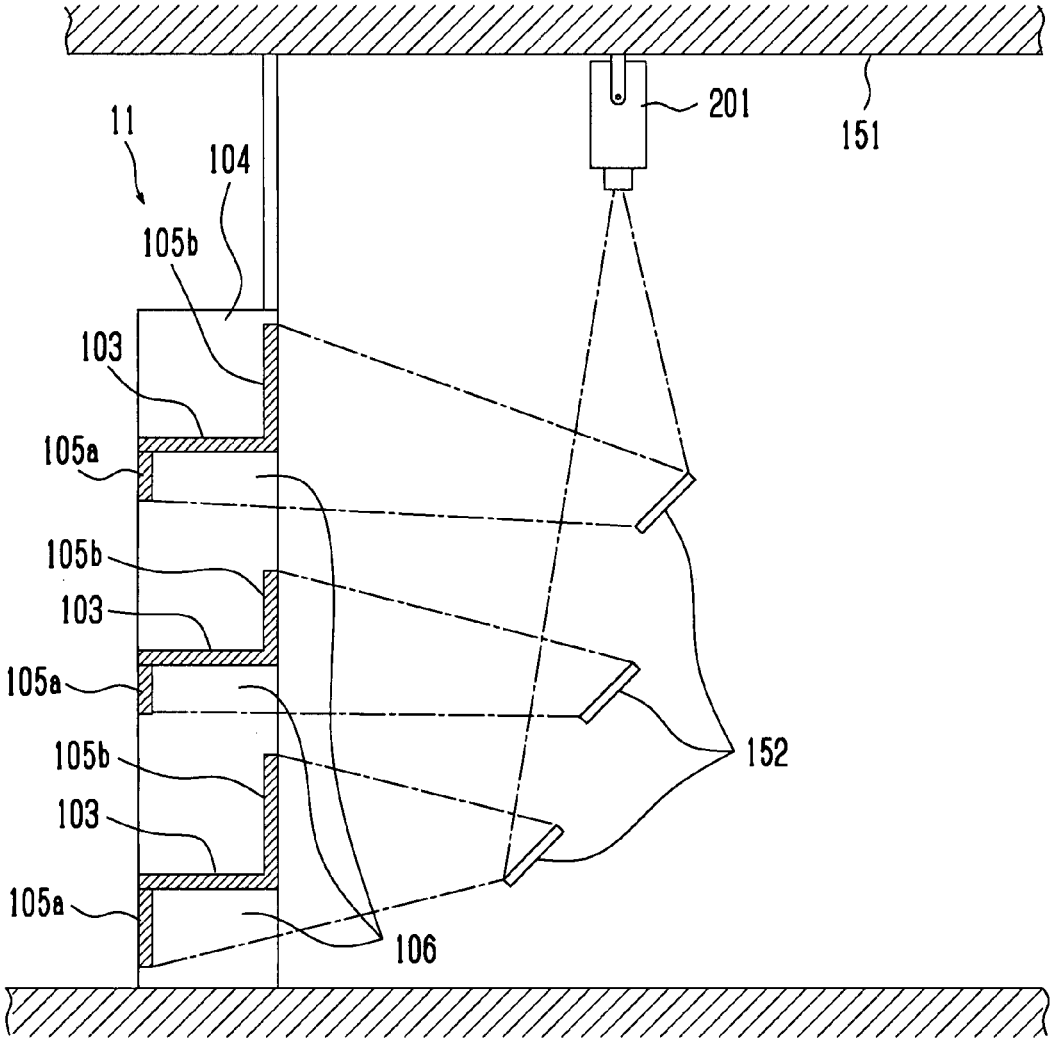
FIG. 7 is a side view in vertical section showing a display shelf and a projector of the second embodiment of the present invention.

Next, a second embodiment of the present invention will be explained with reference to the drawings. FIG. 7 is a side view in vertical section showing a display shelf 101 and a projector 201 of the second embodiment of the present invention. For the explanation of the second embodiment of the present invention, the same structural elements to the first embodiment will be assigned the same reference number and an explanation thereof will be omitted.

As shown in FIG. 7, the second embodiment has the projector 201, which is fixed to the ceiling surface 151 of a building, and three mirrors 152 as reflecting mirrors are added. The three mirrors 152 located at different heights.

In the second embodiment, the projector 201 projects a projector image luminous flux downwardly. Each of the three mirrors 152 receives one of the projector image luminous fluxes from the projector 201, and reflects and projects it. The three mirrors 152 constitute an image division unit which divides the projector image luminous fluxes, and reflects them in the directions of the first and second screens 105*a* and 105*b* of the display shelf 101.

A lower mirror 152 reflects and projects one of the projector image luminous fluxes from the projector 201 to the first and the second screens 105*a* and 105*b* provided in the lower placing table 103. An upper mirror 152 reflects and projects one of the projector image luminous fluxes from the projector 201 to the first and the second screen 105*a* and 105*b*, which are provided in the upper placing table 103.

The mirrors 152 divide and reflect the projector images from the projector 201 and project a plurality of the divided projector image luminous fluxes to the first and the second screens 105*a* and 105*b* of the display shelf 101 so that the projector image luminous fluxes are transmitted and projected in a similar manner to FIG. 6.

Figure 8:
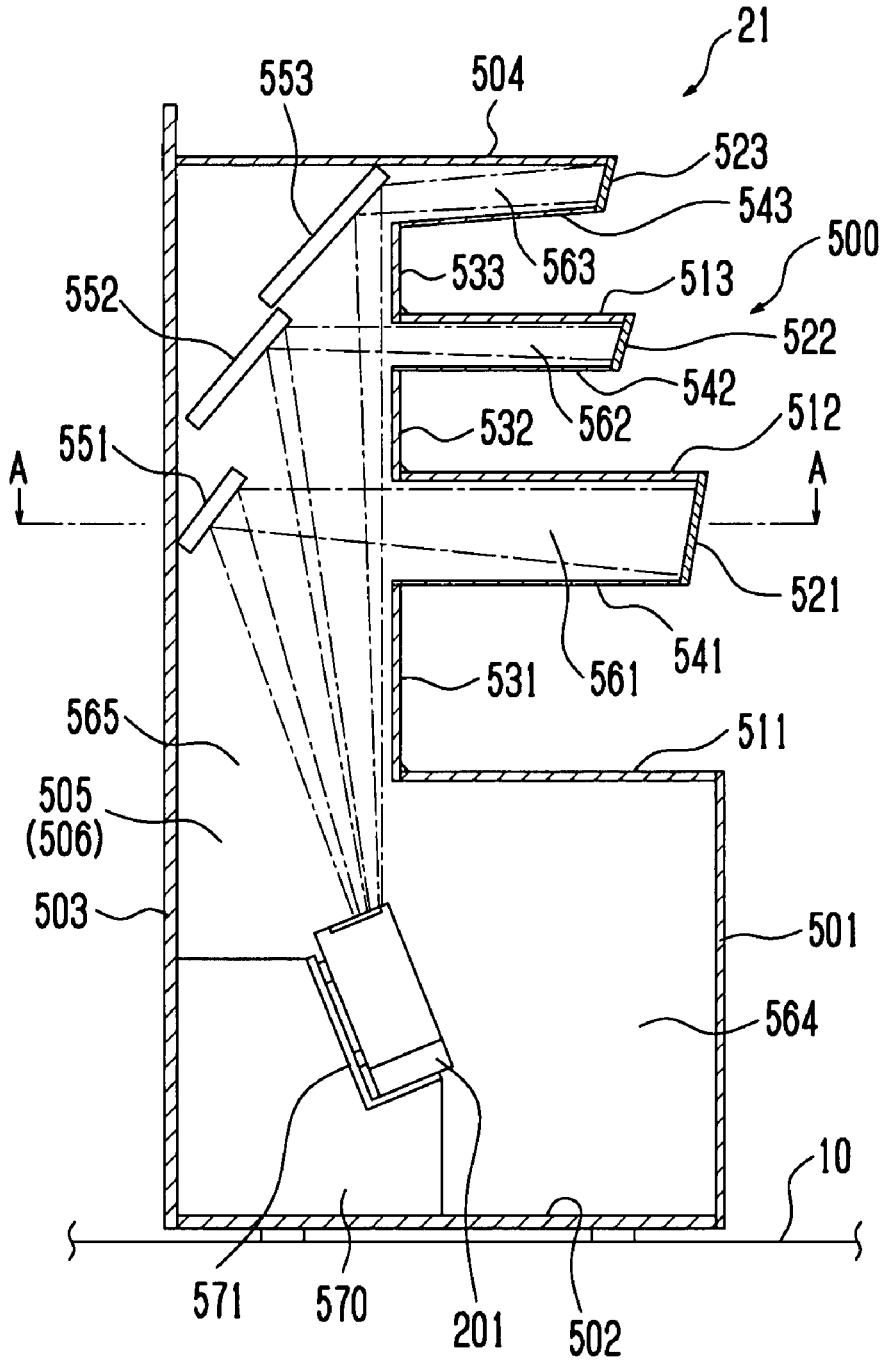
FIG. 8 is a side view in vertical section showing a display shelf of the third embodiment of the present invention.
Figure 9:
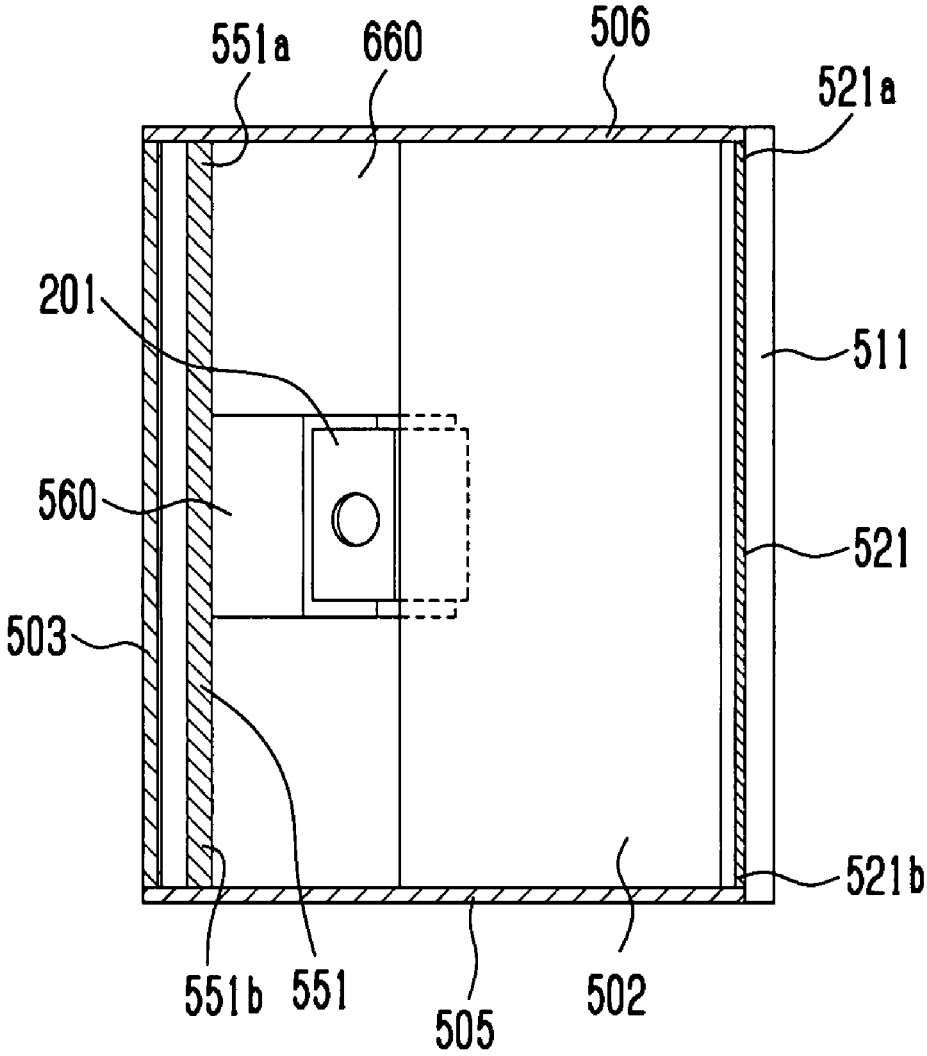
FIG. 9 is a cross-sectional view showing the display shelf cut by the A-A line in FIG. 8.

Next, a third embodiment of the present invention will be explained with reference to the drawings. FIG. 8 is a side view in vertical section showing a display shelf of the third embodiment of the present invention. FIG. 9 is a cross-sectional view showing the display shelf cut by the A-A line in FIG. 8. For an explanation of the third embodiment of the present invention, the same structural elements to the first and the second embodiments will be assigned the same reference numbers, and explanation thereof will be omitted.

The third embodiment of the present invention relates to a display shelf system 21 suitable for a usage in a supermarket which is similar to the first and the second embodiments.

As shown in FIG. 8, the third embodiment of the present invention provides a display shelf 500, a projector 201, and the computer (see FIG. 1). The display shelf 500 is situated in a floor 10. The projector 201 is located in an inner part of the display shelf 500. The computer is located in a backyard of the display shelf 500.

Here, a structure of the computer and the image contents displayed to the display shelf system 21 are similar to the first and the second embodiments as explained above, so detailed explanation thereof will be omitted.

The display shelf 500 has a lower front panel 501, a bottom panel 502, a backboard 503, and a top panel 504. The lower front panel 501, the bottom panel 502, the backboard 503, and the top panel 504 are located such that a pair of side panels 505 and 506 sandwich them. The bottom panel 502 constitutes a bottom of the display shelf 101. The backboard 503 constitutes a back the display shelf 101. The top panel 504 constitutes a top of the display shelf 101.

The display shelf 500 has three display boards 511, 512, and 513. The three display boards 511, 512, and 513 constitute a three-layer placing table.

That is, the display board 511, which constitutes the lower placing table, is placed at an upper side of the lower front panel 501. At an upper side of the display board 511, the display board 512, which constitutes the second placing table, is placed. At an upper side of the display board 512, the display board 513, which constitutes the third placing table, is placed. These display boards 511, 512, and 513 are sandwiched by the side panels 505 and 506 to be fixed horizontally.

Figure 10:
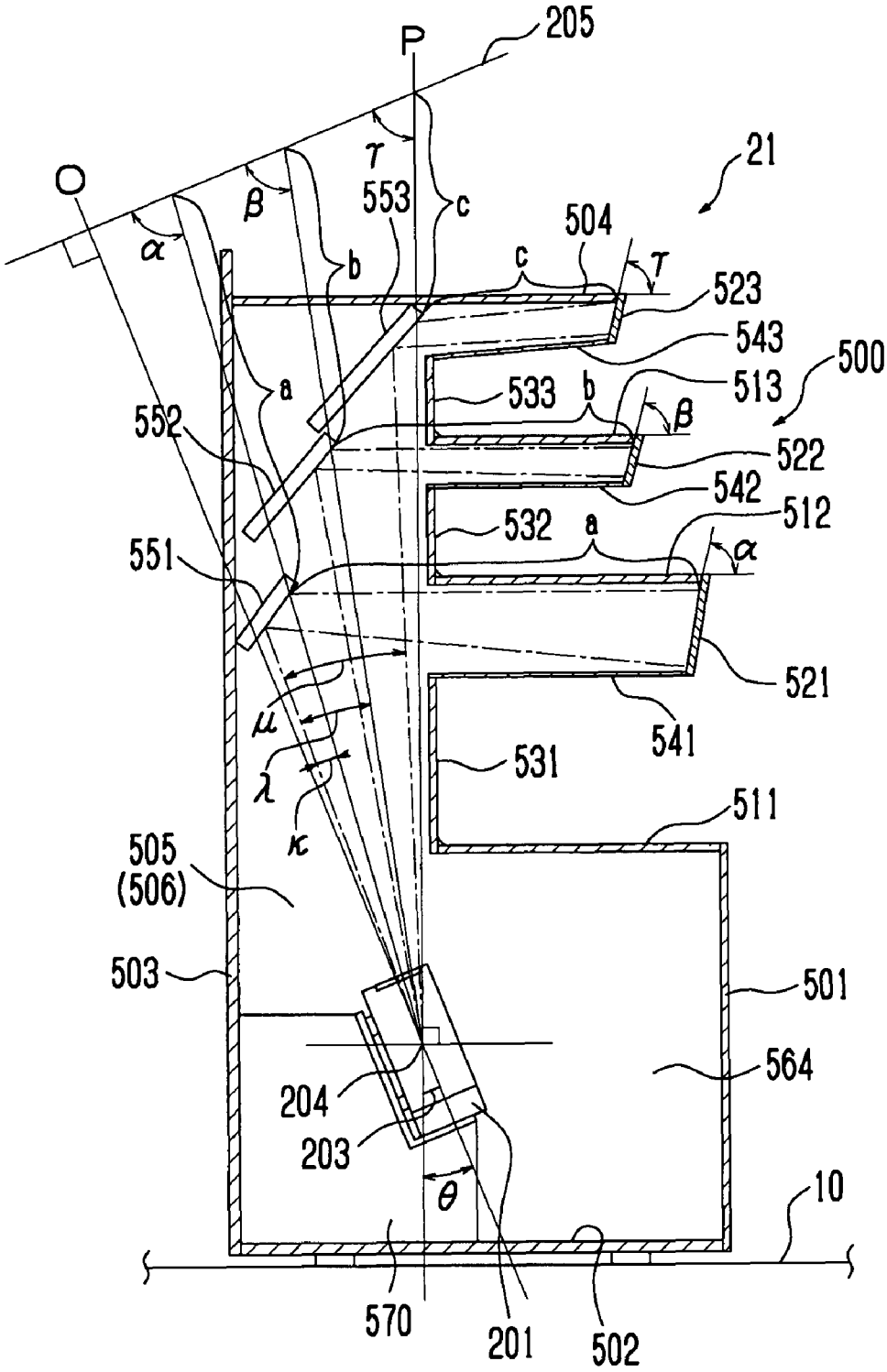
FIG. 10 is a cross-sectional view for explaining an optical system of the display shelf of the third embodiment of the present invention.

Further, at upper parts of the display boards 511, 512, and 513, screens 521, 522, and 523 are placed corresponding to each of the display table. The screens 521, 522, and 523 are, for example, formed by milky white acryl plate. A projector image luminous flux projected from a backside of the screens 521, 522, and 523 can be seen from a front side thereof. That is, the screens 521, 522, and 523 are a transmission-type. The screen 521 extends from a front part of the display board 512 downwardly, and is placed to be at a predetermined angle of $\alpha$ to the horizontal direction (see FIG. 10). The screen 522 extends from a front part of the display board 513 downwardly, and is placed to be at a predetermined angle of $\beta$ to the horizontal direction (see FIG. 10). The screen 523 extends from a front part of the top panel 504 downwardly, and is placed to be at a predetermined angle of $\gamma$ to the horizontal direction (see FIG. 10).

Here, the screens 521 and 522 are fixed to the display boards 512 and 513 and are fixed to the side panels 505 and 506.

Further, back panels 531, 532, and 533, which define widths of the placing table, are placed at a back end part of the display boards 511, 512, and 513.

Further, ceiling panels 541, 542, and 543, which constitute ceiling parts of the display shelf, are placed along the highest part of each of the back panels 531, 532, and 533 to the display boards 511, 512 and 513.

A space defined by the display board 511, the back panel 531 and the ceiling panel 541 constitutes a display space for displaying articles on the display board 511. It is same for a space defined by the display board 512, the back panel 532 and the ceiling panel 542, and a space defined by the display board 513, the back panel 533 and the ceiling panel 543.

In this example, the ceiling panels 541 and 542 are placed in parallel with the display board 511 and 512. The ceiling panel 543 is placed to be at a predetermined angle to the horizontal direction not to disturb the projector image luminous flux, which is projected to the screen 523. Each of lower end part of the screens 521, 522, and 523 are fixed to a front upper end part of each of the ceiling panels 541, 542, and 543.

A back surface of the screen 521, an upper surface of the ceiling panel 541, a bottom surface of the display board 512, and inner surfaces of the side panels 505 and 506 constitute an inner circumference which defines a space including a horizontal image projecting space 561 which leads the projector image luminous flux projected from the back side of the screen 521 to the back surface of the screen 521 without obstruction.

Similarly, a back surface of the screen 522, an upper surface of the ceiling panel 542, a bottom surface of the display board 513, and inner surfaces of the side panels 505 and 506 constitute an inner circumference which defines a space including a horizontal image projecting space 562 which leads the projector image luminous flux projected from the back side of the screen 522 to the back surface of the screen 522 without obstruction.

Similarly, a back surface of the screen 523, an upper surface of the ceiling panel 543, a bottom surface of the top panel 504, and inner surfaces of the side panels 505 and 506 constitute an inner circumference which defines a space including a horizontal image projecting space 563 which leads the projector image luminous flux projected from the back side of the screen 523 to the back surface of the screen 523 without obstruction.

As described above, the ceiling panels 541, 542, and 543 are placed downward of the horizontal image projecting spaces 561, 562, and 563. Therefore, this prevents an article (an item) placed on the display boards 511, 512, and 513 from entering into the horizontal image projecting spaces 561, 562, and 563, and prevents the article (an item) from shading on the projector image luminous flux.

Further, a lower part of the display shelf 500, an inner surface of the front panel 501, an upper surface of the bottom panel 502, an inner surface of the backboard 503, and inner surfaces of the side panels 505 and 506 constitute an inner circumference which defines a projector placing space 564 where the projector 201 is placed. Inner surfaces of the back panels 531, 532, and 533, an inner surface of the backboard 503, and inner surfaces of the side panels 505 and 506 constitute an inner circumference which defines a space including vertical image projecting space 565 which leads the projector image luminous flux from the projector 201 vertically.

The projector 201 is placed at the projector placing space 564. The projector 201 is placed on a projector placing table 570 as a projector placing part which is located on the bottom panel 502. The projector placing table 570 has a predetermined placing part 571. The placing part 571 of the projector placing table 570 places the projector 201 to be inclined to have a predetermined angle of $\theta$ between an optical axis O (see FIG. 10) of the projector 201 and the vertical line P. As can be seen, the placing space 564 of the projector 201 can be decreased by placing the projector 201 to have the inclination.

Plane mirrors 551, 552, and 553 as reflecting mirrors are placed at the vertical image projecting space 565. The plane mirrors 551, 552, and 553 are placed so as to reflect and project the projector image luminous flux, which is projected from the projector 502, to the three screens 521, 522, and 523. As shown in FIG. 9, these plane mirrors 551, 552, and 553 are placed and fixed its both end parts to the side panels 505 and 506.

Next, a positional relationship among the projector 201, the plane mirrors 551, 552, and 553, and the screens 521, 522, and 523 will be explained.

The projector 201 provides a liquid crystal display device 203 in its inside. The liquid crystal display 203 displays the projector image luminous flux of one display. The projector 201 projects the projector image luminous flux from the liquid crystal display 203. The plane mirrors 551, 552, and 553 reflect the projector image luminous flux from the projector 201 and project it in substantially horizontal direction. The projector image luminous flux from the plane mirrors 551, 552, and 553 are lead to the horizontal image projecting spaces 561, 562, and 563. The plane mirrors 551, 552, and 553 reflect the projector image luminous flux from the projector 201 and project it to the screens 521, 522, and 523 through the horizontal image projecting spaces 561, 562, and 563.

Here, the projector image luminous flux to be projected is divided in a band like manner and displays necessary information as explained in the first embodiment of the present invention.

Thus, a position of the projector 201 is decided such that the projector image luminous flux from the liquid crystal display device 203 of the projector 201 focuses precisely on each of the screens 521, 522, and 523.

Here, when the plane mirrors 551, 552, and 553 are not placed, the optical axis O of a projecting optical system of the projector 201 is at an angle of $\theta$ to the vertical line P. The projector image luminous flux of the liquid crystal display device 203 makes a focus on an image plane vertical to the optical axis O, that is, on a hypothetical image plane 205, and is projected precisely.

The plane mirrors 551, 552, and 553 and the screens 521, 522, and 523 are placed such that the plane mirrors 551, 552, and 553 reflect the projector image luminous flux to focus on the screen 521, 522, and 523. That is, the liquid crystal display device 203, and the screens 521, 522, and 523 are arranged such that the liquid crystal display device 203 acts as an object surface, and the screens 521, 522, and 523 act as an image surface in a reflecting optical system which comprises the plane mirrors 551, 552, and 553.

When the plane mirror 551 is not placed, the projector image luminous flux to be projected to a highest part of the screen 521 is at an angle of $\kappa$ to the optical axis O, passes an main point 204 of a light emitting side of the lens 202, then reflected at the plane mirror 551, and reaches to the hypothetical image plane 205. In this event, an angle made by the projector image luminous flux and the image plane 205 is $\alpha(\alpha=\pi/2-\kappa)$ and a reflection surface of the mirror 551 is apart from the image plane 205 by a distance 'a'.

Therefore, when the plane mirror 551 is placed, a position of an upper end of the screen 521 is apart from the plane mirror 551 by the distance 'a', and the screen 521 is arranged to be inclined by an angle of $\alpha$ in a backward direction of the screen 521 to the display board 512, which is placed horizontally.

As described above, when the plane mirror 551 and the screen 521 are placed, the liquid crystal display device 203 and the screen 521 are placed in a conjugate position.

Similarly, the plane mirror 552 and the screen 522 are placed in a similar positional relationship to that of the plane mirror 551 and the screen 521. Also, the plane mirror 553 and the screen 523 are placed in a similar positional relationship to that of the plane mirror 551 and the screen 521.

That is, an upper edge part of the screen 522 is apart from the plane mirror 552 by a distance 'b', and the screen 522 is arranged to be inclined by an angle of $\beta(\pi/2-\lambda)$ in a backward direction of the screen 522 to the display board 513.

Further, an upper edge part of the screen 523 is apart from the plane mirror 553 by a distance 'c', and the screen 523 is arranged to be inclined by an angle of $\gamma(\pi/2-\mu)$ in a backward direction of the screen 523 to the top panel 504.

When the display shelf 500 meets the above-described criteria, the projector image luminous flux of the projector 201 focuses on the screens 521, 522, and 523, respectively, and the projections can be made precisely.

Thus, according to the third embodiment of the present invention, the projector image luminous flux of the projector 201 is projected precisely such that the projector image luminous flux focuses on each of the screens, and it can be prevented that the article, which is displayed on the display boards, shades on the projector image luminous flux.

Figure 11:
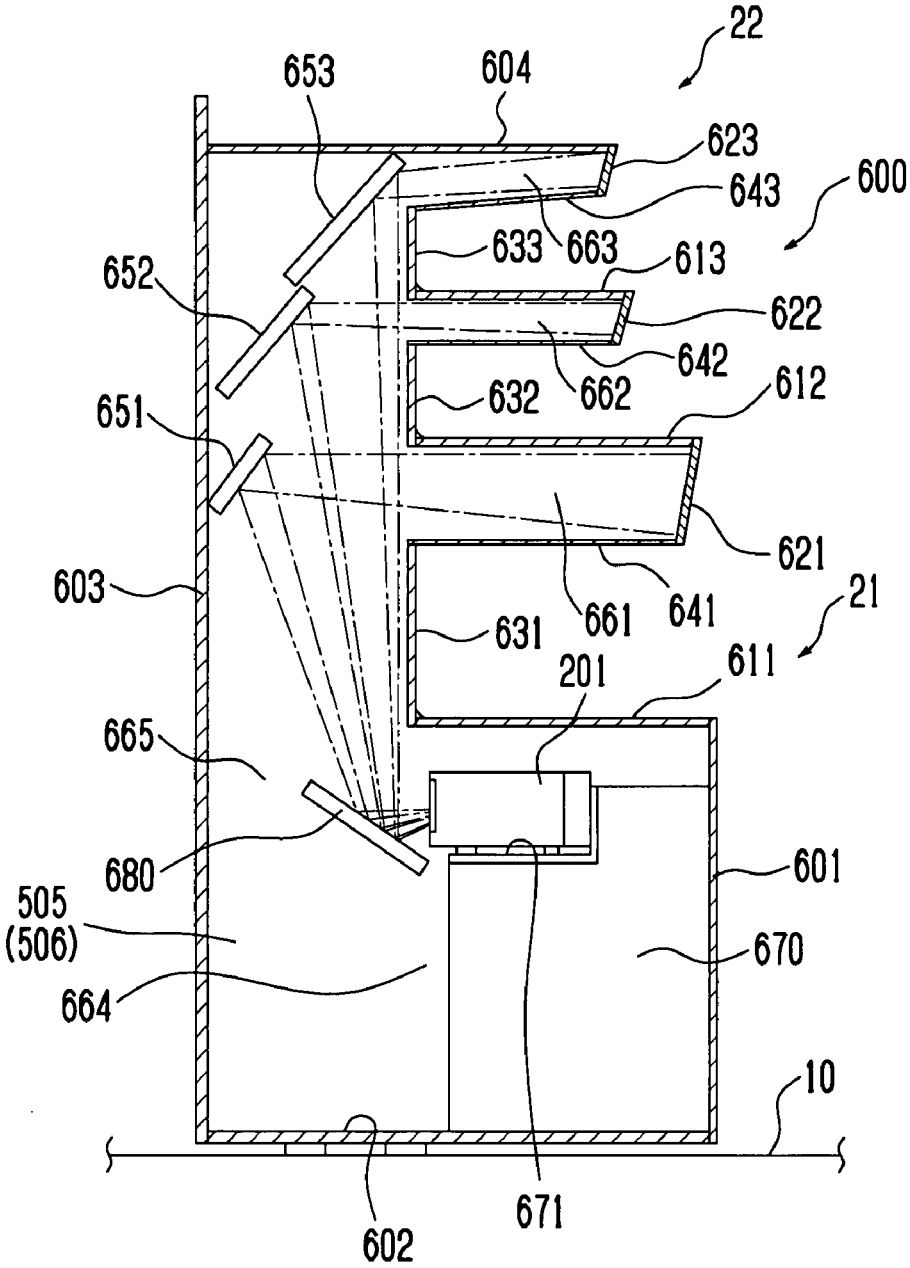
FIG. 11 is a side view in vertical section showing a display shelf of the fourth embodiment of the present invention.
Figure 12:
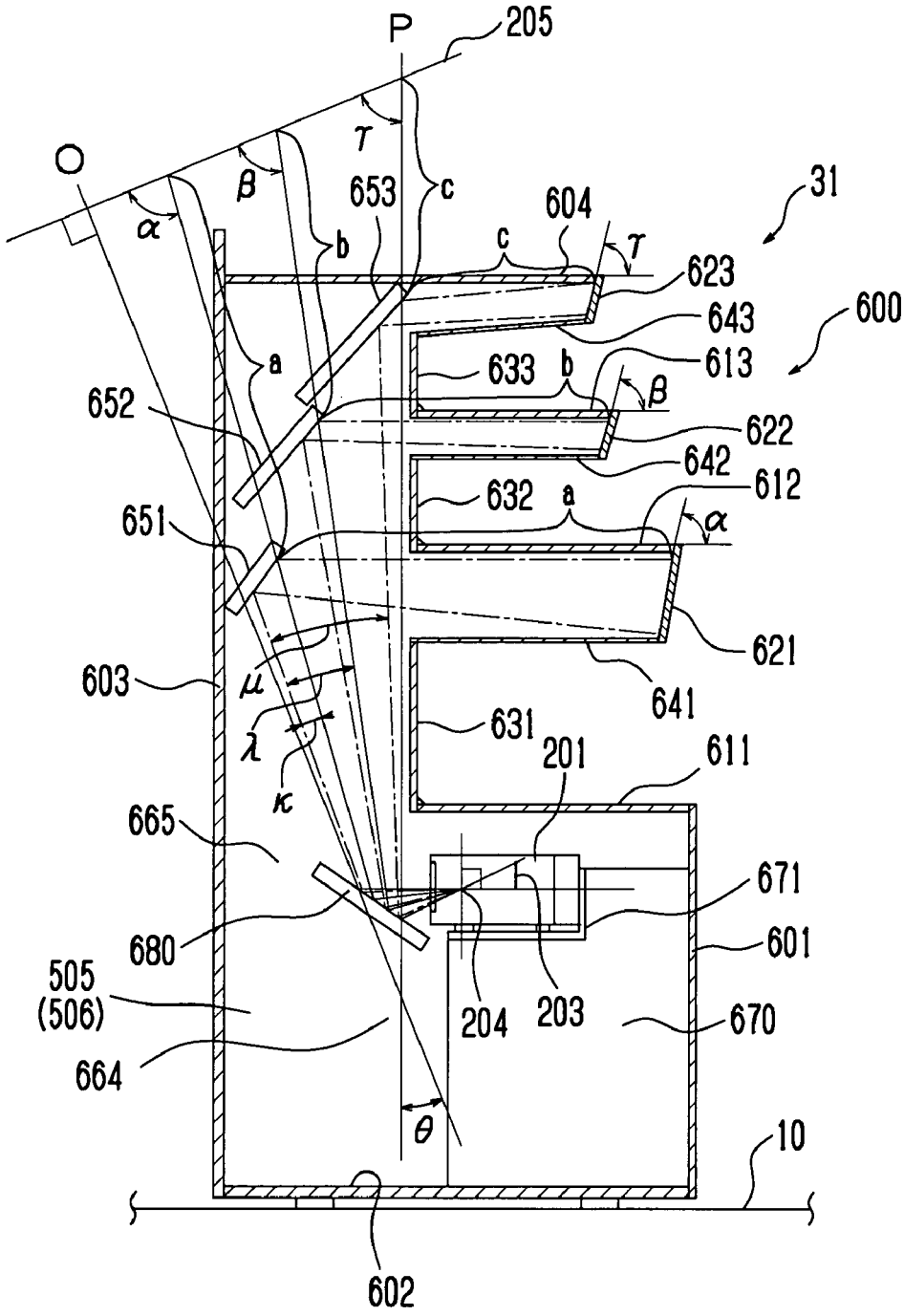
FIG. 12 is a side view in vertical section for explaining an optical system of the display shelf of the fourth embodiment of the present invention.

Next, a fourth embodiment of the present invention will now be explained with reference to the drawings. FIG. 11 is a side view in vertical section showing a display shelf of the fourth embodiment of the present invention. FIG. 12 is a side view in vertical section for explaining an optical system of the display shelf of the fourth embodiment of the present invention. In the fourth embodiment, the same structural elements to the first to the third embodiment will be assigned the same reference numbers, and an explanation thereof will be omitted.

The fourth embodiment of the present invention employs a projector, which adopts mercury lamp and so on, and which is for a horizontal arrangement use only.

A display shelf system 22 with respect to the fourth embodiment of the present invention has a projector placing table 670 instead of the projector placing table 570 of the third embodiment, and additionally comprises a reflecting mirror 680 as a second reflecting mirror. Other structure in the fourth embodiment except above is the same as the third embodiment of the present invention.

The display shelf system 22 with respect to the fourth embodiment comprises the display shelf 600, the projector 201, and the computer (see FIG. 1). The display shelf 600 is placed on the floor surface 10. The projector 201 is placed inside the display shelf 600. The computer is placed at a backyard of the display shelf 600. The display shelf 600 comprises the lower front panel 601, the bottom panel 602, a backboard 603, and the top panel 604. The lower front panel 601, the bottom panel 602, the backboard 603, and the top panel 604 are placed such that the pair of side panels 505, 506 sandwich them.

The display shelf 600 comprises the three display boards 611, 612, and 613. The three display boards 611, 612, and 613 constitute a three-layered placing table.

The display board 611, which constitutes the lower placing table, is placed at an upper part of the lower front panel 601. The display board 612, which constitutes the second placing table, is placed at an upper part of the display board 611. The display board 613, which constitutes the third display table, is placed at an upper part of the display board 612. These display boards 611, 612, and 613 are sandwiched by the side panels 505 and 506, and to be fixed horizontally.

Further, screens 621, 622, and 623 are placed at an upper part of each of the display boards 611, 612, and 613. The screens 621, 622, and 623 are formed with milky white acryl plate, for example. A projected image flux projected from backward can be seen at its front surface of the screens 621, 622, and 623. That is, the screens 621, 622, and 623 are a transmission-type.

The screen 621 extends downward from a front end part of the display board 612, and is arranged to be at a predetermined angle of $\alpha$ (see FIG. 12) to the horizontal direction. The screen 622 extends downward from a front end part of the display board 613, and is arranged to be at a predetermined angle of $\beta$ (see FIG. 12) to the horizontal direction. The screen 623 extends downward from a front end part of the top panel 604, and is arranged to be at a predetermined angle of $\gamma$ (see FIG. 12) to the horizontal direction.

Here, the screens 621 and 622 are fixed to the display boards 612 and 613, and to the side panels 505, 506 (see FIG. 9).

Further, back panels 631, 632, and 633 are placed for defining widths of the placing tables are placed at back end parts of the display boards 611, 612, and 613.

Further, ceiling panels 641, 642, and 643, which constitute ceiling parts of the display shelf, are arranged from each of the highest part of the back panels 631, 632, and 633 along each of the display boards 611, 612, and 613. In this example, the ceiling panels 641 and 642 are placed in parallel with the display boards 611 and 612. The ceiling panel 643 is placed to have a predetermined inclination with respect to the horizontal direction not to disturb the projector image luminous flux, which is projected to the screen 623. Each of lower end parts of the screens 621, 622, and 623 are fixed at each of front upper end parts of the ceiling panels 641, 642, and 643 respectively. Then, a back surface of the screen 621, an upper surface of the ceiling panel 641, a lower surface of the display board 612, and inner surface of the side panels 505, 506 constitute an inner circumference defining a space including a horizontal image projecting space 661 which leads the projector image luminous flux projected from a back side of the screen 621 to the back surface of the screen 621 without obstruction.

Similarly, a back surface of the screen 622, an upper surface of the ceiling panel 642, a lower surface of the display board 613, and inner surface of the side panels 505 and 506 constitute an inner circumference defining a space including a shoulder part image projecting space 662 which leads the projector image luminous flux projected from a back side of the screen 622 to the back surface of the screen 622 without obstruction.

Similarly, a back surface of the screen 623, an upper surface of the ceiling panel 643, a lower surface of the top panel 604, and inner surface of the side panels 505, 506 constitute an inner circumference defining a space including a horizontal image projecting space 663 which leads the projector image luminous flux projected from a back side of the screen 623 to the back surface of the screen 623 without obstruction.

When the ceiling panels 641, 642, and 643 are placed as described above, an article (an item) placed on the display boards 511, 512, and 513 are prevented from entering into the horizontal image projecting spaces 661, 662, and 663, and from shading on the projector image luminous flux by the article (an item) is also prevented.

Also, a lower part of the display shelf 600, an inner surface of the front panel 601, an upper surface of the bottom panel 602, an inner surface of the backboard 603, and an inner surface of the side panels 505, 506 constitute an inner circumference defining a projector placing space 664 for placing the projector 201. Inner surfaces of the back panels 631, 632, and 633, an inner surface of the backboard 603, and an inner surface of the side panels 505, 506 constitute an inner circumference defining a space including a vertical image projecting space 665 which leads the projector image luminous flux projected from the projector 201 in the vertical direction.

The projector 201 is placed in the projector placing space 664. The projector 201 is placed on a projector placing table 670 as a projector placing table placed on the bottom panel 602. The projector placing table 670 has a placing part 671 for placing the projector 201 in substantially horizontal direction. The placing part 671 of the projector placing table 670 is formed such that an optical axis O (see FIG. 12) of the projector 201 is arranged horizontally when the projector 201 is in a placing status. The projector image luminous flux from the projector 201 is projected along the optical axis O. By placing the projector 201 in substantially horizontal manner as described above, a light source such as the mercury lamp and so on in the projector 201 is stable enough to emit a light.

Adjacent to the projector 201, the reflecting mirror 680 as the second reflecting mirror is placed. The reflecting mirror 680 is a plane mirror and is fixed to the side panels 505, 506 and the backboard 603. Also, the reflecting mirror 680 can be fixed to the projector placing table 670.

The reflecting mirror 680 is arranged such that the optical axis O of the projector 201 is at an angle of $\theta$ to the vertical line P so that the projector image luminous flux of the projector 201 can be reflected.

A condition of a light path of the projector image luminous flux and the optical system after the reflecting mirror 680 is the same as the third embodiment of the present invention.

That is, plane mirrors 651, 652, and 652 as reflecting mirrors are placed in the vertical image projecting space 665. Both ends of the plane mirrors 651, 652, and 653 are fixed to the side panels 505, 506.

The relationship between the plane mirrors 651, 652, and 653 and the screens 621, 622, and 623 are the same as the third embodiment.

The projector 201 provides a liquid crystal display device 203, and so on in its inside. The projector 201 projects the projector image luminous flux from the liquid crystal display device 203.

The plane mirrors 651, 652, and 653 project and reflect the projector image luminous flux from the projector 201 and project it in substantially horizontal direction. The projector image luminous fluxes from the plane mirrors 651, 652, and 653 are projected into the horizontal image projecting spaces 661, 662, and 663. The plane mirrors 651, 652, and 653 reflect the projector image luminous flux from the projector 201 and project it to the screens 621, 622, and 623 through the horizontal image projecting spaces 661, 662, and 663.

The plane mirrors 651, 652, and 653 and the screens 621, 622, and 623 are placed such that the plane mirrors 651, 652, and 653 reflect the projector image luminous flux to focus on the screens 621, 622, and 623. That is, in a reflecting optical system comprising the plane mirrors 651, 652, and 653, the liquid crystal display device 203 and the screens 621, 622, and 623 are placed such that the liquid crystal display device 203 acts as an object surface, and the screens 621, 622, and 623 act as an image surface.

Therefore, when the plane mirror 651 is placed, a position of an upper end part of the screen 621 is apart from the plane mirror 651 by a distance of 'a', and the screen 621 is arranged to be inclined by an angle of $\alpha$ in a backward direction of the screen 621 to the display board 612, which is placed horizontally.

As described above, when the plane mirror 651 and the screen 621 are placed, the liquid crystal display device 203 and the screen 621 are placed in a conjugate position.

Similarly, the plane mirror 652 and the screen 622 are arranged in a similar positional relationship to the plane mirror 651 and the screen 621. Also, the plane mirror 653 and the screen 623 are arranged in a similar positional relationship to the plane mirror 651 and the screen 621.

That is, an upper edge part of the screen 622 is apart from the plane mirror 652 by a distance of 'b', and the screen 622 is arranged to be inclined at an angle of $\beta$ $(\pi/2-\lambda)$ in a backward direction of the screen 622 to the display board 613.

Also, an upper edge part of the screen 623 is apart from the plane mirror 653 by a distance of 'c', and the screen 623 is arranged to be inclined at an angle of $\gamma(\pi/2-\mu)$ in a backward direction of the screen 623 to the top panel 604.

When the display shelf 600 meets such criteria described above, the projector image luminous flux of the projector 201 focuses on the screens 621, 622, and 623, and is projected precisely.

Therefore, according to the fourth embodiment of the present invention, the projector image luminous flux of the projector 201 is projected precisely such that the projector image luminous flux focuses on each of the screens 621, 622, and 623, and an obstruction to the projector image luminous flux made by the articles displayed on the display boards can be prevented. Further, according to the display shelf system 22 of the fourth embodiment, since the projector is placed in the horizontal direction, any type of projectors, which cannot be inclined, can be adoptable.

Here, the third and fourth embodiments may have screens instead of the back panels 631, 632, and 633, and also the projector image luminous flux can be displayed on these screens.

Further, the number and the position of the display shelves can be changed according to need. Still further, the numbers and the positions of the projector, the plane mirrors, and the screens can be changed in accordance with the number of the display shelves, its shape, and a specification of the projector.

According to the present invention, since a projector image luminous flux can be transmitted and projected on a screen positioned at a front area of a placing table and the screen corresponds to the placing table on which an article can be displayed, an information display area regarding the articles, which are placed on the placing tables, can be taken wide.

Obviously, numerous modifications and variations of the present invention are possible in light of the above teachings. It is therefore to be understood that within the scope of the appended claims, the invention may be practiced otherwise than as specifically described herein.

What is claimed is:

1. A display shelf comprising:

a plurality of placing tables for placing articles;

a plurality of transmission-type screens which are positioned at front areas of the placing tables, and which transmit and project projector image luminous fluxes that are projected from back sides of the screens;

an inner circumference defining a space including an image projecting space which leads the projector image luminous fluxes projected from the back sides of the screens to back surfaces of the screens without obstruction;

a projector placing part on which a projector is placeable, wherein the projector is configured to project the projector image luminous fluxes;

a plurality of reflecting mirrors which are placed in the image projecting space corresponding to the plurality of screens, and which reflect and lead the respective projector image luminous fluxes from the projector to the corresponding screens, wherein the projector placing part is arranged such that the projector image luminous fluxes to be projected are focused on the corresponding screens, and wherein each of the plurality of transmission-type screens is placed to have an optical distance from a standard surface of the projector such that the plural screens are placed at a projecting image surface in a reflecting and focusing system of the projector image luminous fluxes projectable from the projector; and a plurality of ceiling panels which are provided corresponding to the plurality of screens, and which are placed under corresponding horizontal image projecting areas so as to prevent the articles from entering into the corresponding horizontal image projecting areas.

2. The display shelf according to claim 1, wherein the plurality of transmission-type screens are formed end-to-end in a width direction of the placing tables without having a cut line.

3. The display shelf according to claim 1, wherein each of the plural screens is set to be substantially vertical to an optical axis of the projector.

4. The display shelf according to claim 1, wherein the projector placing part is adapted to place the projector in a substantially horizontal manner.

5. The display shelf according to claim 4, further comprising a main reflecting mirror for reflecting and leading the projector image luminous fluxes projected from the projector to the corresponding reflecting mirrors.

6. A display shelf comprising:

a plurality of placing tables for placing articles, the plurality of placing tables being placed at different heights;

a plurality of transmission-type screens which are fixed to upper placing tables of the placing tables or to a member placed above a top placing table, and which are placed at a front part of each of the upper placing tables and the member, and which transmit and project projector image luminous fluxes projected from back sides thereof;

a projector placing part on which a projector is placeable, wherein the projector is configured to project the projector image luminous fluxes which constitute a single display image;

a first inner circumference defining a space including a vertical projecting area for leading the projector image luminous fluxes from the projector in a substantially vertical direction;

a plurality of reflecting mirrors which are placed in the vertical projecting area corresponding to the plurality of screens, and which reflect and project the respective projector image luminous fluxes from the projector in a substantially horizontal direction to the corresponding screens, wherein the projector placing part is arranged such that the projector image luminous fluxes to be projected are focused on the corresponding screens, and wherein each of the plurality of transmission-type screens is placed to have an optical distance from a standard surface of the projector such that the plural screens are placed at a projecting image surface in a reflecting and focusing system of the projector image luminous fluxes projectable from the projector;

a plurality of second inner circumferences defining spaces including a plurality of horizontal image projecting areas which lead the plurality of projector image luminous fluxes in the substantially horizontal direction and project the projector image luminous fluxes on the corresponding screens; and a plurality of ceiling panels which are provided corresponding to the plurality of screens, and which are placed under the corresponding horizontal image projecting areas so as to prevent the articles from entering into the corresponding horizontal image projecting areas.

7. The display shelf according to claim 6, wherein the projector placing part is adapted to place the projector in a substantially horizontal manner, and the display shelf further comprises a main reflecting mirror between the projector placing part and the plurality of second inner circumferences for reflecting the projector image luminous fluxes projected from the projector and leading the reflected projector image luminous fluxes to the vertical projecting area.

8. A display shelf system comprising:

a display shelf comprising:

a plurality of placing tables for placing articles;

a plurality of transmission-type screens which are positioned at front areas of the placing tables, and which transmit and project projector image luminous fluxes that are projected from back sides of the screens to back surfaces of the screens; and an inner circumference defining a space including an image projecting space which leads the projector image luminous fluxes projected from the back sides of the screens to the back surfaces of the screens without obstruction;

a projector placing part on which a projector is placeable, wherein the projector is configured to project the projector image luminous fluxes;

a plurality of reflecting mirrors which are placed in the image projecting space corresponding to the plurality of screens, and which reflect and lead the respective projector image luminous fluxes from the projector to the corresponding screens, wherein the projector placing part is arranged such that the projector image luminous fluxes to be projected are focused on the corresponding screens, and wherein each of the plurality of transmission-type screens is placed to have an optical distance from a standard surface of the projector such that the plural screens are placed at a projecting image surface in a reflecting and focusing system of the projector image luminous fluxes projectable from the projector; and a plurality of ceiling panels which are provided corresponding to the plurality of screens, and which are placed under corresponding horizontal image projecting areas so as to prevent the articles from entering into the corresponding horizontal image projecting areas;

wherein the display shelf system further comprises:

the projector which is placed at the projector placing part and which projects the projector image luminous fluxes on the corresponding screens; and a computer which transmits image data to the projector.

9. The display shelf system according to claim 8, further comprising means for dividing a main projector image luminous flux into the projector image luminous fluxes and projecting the divided projector image luminous fluxes on the corresponding plurality of screens.

* * * * *